United States Patent [19]

Niemirow

[11] 4,129,905

[45] Dec. 19, 1978

[54] SWIMMING POOL RESCUE NET

[76] Inventor: Jerzy Niemirow, Riverside, N.J. 08075

[21] Appl. No.: 811,546

[22] Filed: Jun. 30, 1977

[51] Int. Cl.[2] ..... E04H 3/19

[52] U.S. Cl. ..... 4/172.13

[58] Field of Search ..... 4/172.13, 172.12, 172.11, 4/172

[56] References Cited

U.S. PATENT DOCUMENTS

| | | | |
|---|---|---|---|
| 1,101,166 | 6/1914 | Collins | 4/172.13 |
| 3,000,017 | 9/1961 | Skovira | 4/172.13 |
| 3,229,309 | 1/1966 | Knodel | 4/172.12 |
| 3,366,977 | 2/1968 | Koehler | 4/172.12 |
| 3,423,768 | 1/1969 | Glenn | 4/172.13 |
| 3,593,757 | 7/1971 | Haynes | 4/172.12 |

*Primary Examiner*—Richard E. Aegerter
*Assistant Examiner*—L. Footland

[57] ABSTRACT

Submerged netting which can immediately rise to water's surface by means of inflatable bladder associated therewith to prevent drowning of endangered victims.

4 Claims, 5 Drawing Figures

SWIMMING POOL RESCUE NET

OBJECTS OF THE INVENTION

This invention relates to water rescue and more particularly concerns the saving of a human life threatened by drowning in a swimming pool.

In the interests of safety, private swimming pools usually require the presence of an adult member, preferably one who can swim, whenever children and the like, play or congregate at the pool. If the adult member could not swim, it was necessary that he throw a line or preserver to the child or somehow pull the child to safety. In many instances, where time is of the essence, the child or victim drowned because rescue means could not be brought into operation quickly enough. Similarly, in the case of commerical pools, the lifeguard was often unable to reach the "swimmer" in time for any number of reasons.

It is therefore an object of this invention to provide means for preventing drowning of persons in swimming pools.

Another object of the invention is to provide such means which is rapid, safe, and yet readily installable in any size or shape swimming pool.

Still another object of the invention is to effect such rescue even by one who cannot swim.

Yet another object of the invention is to provide such means as aforedescribed which may be adapted as a safety net while ice-skating on the pool.

A still further object of the invention is to provide such means which can readily be adapted to serve as a protective covering over the entire pool while not in use or during the off-season.

These and other objects of the invention will become apparent from the following descriptions and accompanying drawings wherein.

Figure 1:
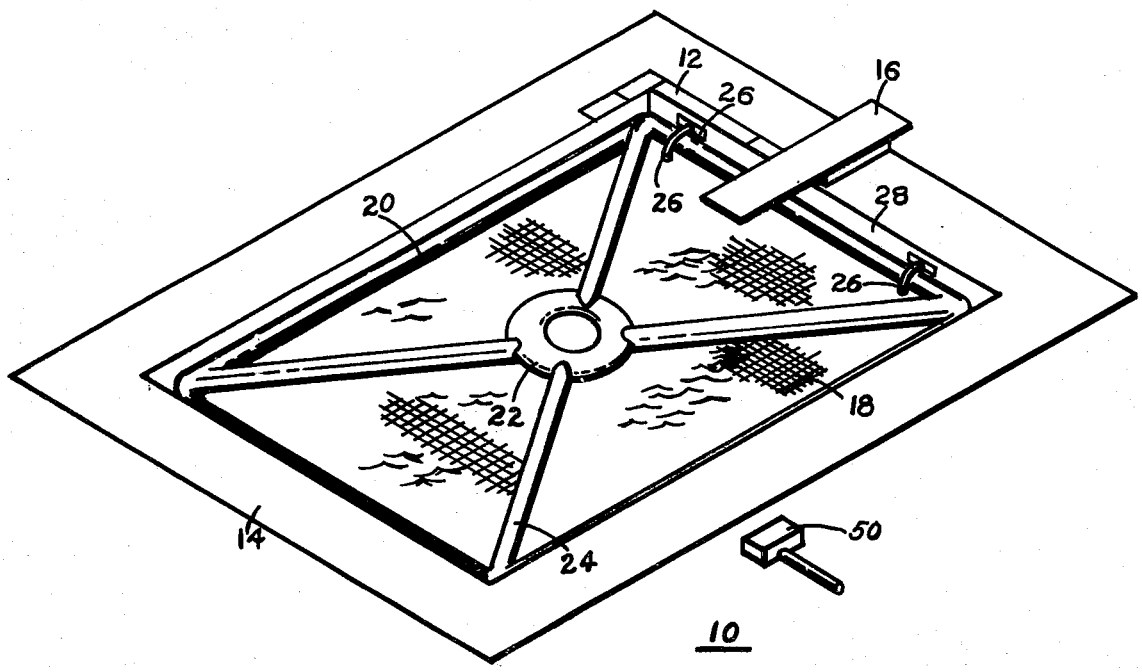
FIG. 1 illustrates a perspective view of my rescue net in operable position.

Referring now to the drawings and more particularly to FIG. 1 thereof, there is shown a typical rectangular shaped swimming pool 10 having coping 12 and a concrete walkway 14 there around. A diving board 16 is positioned at the pool's deeper end. My rescue netting is shown at 18 which is supported by an inflatable bladder having peripheral portions 20, central hub 22, and ribs 24 communicating there between. A peripheral portion of the bladder at the deep end of the pool is maintained and guided in its movement by a pair of spaced vertical guide rods 26—26, held securely to pool wall 28 at their upper ends only by any suitable means, a pair of flanged brackets 28—28 being illustrated herein.

My netting material may be nylon or even plastic, having a diameter of about ⅛ inch. The net openings will be approximately 6 inches square, but if it is desired to bring leaves and other debris quickly to the surface, smaller openings will be used. The net spacing and cord size provide only nominal resistance to the water when the bladder is suddenly inflated and caused to rise to the water's surface with the netting. The ribs and peripheral portions of the bladder will preferably be made of a good grade of rubber and will have a diameter of about 3–4 inches, the hub portion preferably being doughnut-shaped, its size depending on the size of the pool and weight of the net.

Figure 2:
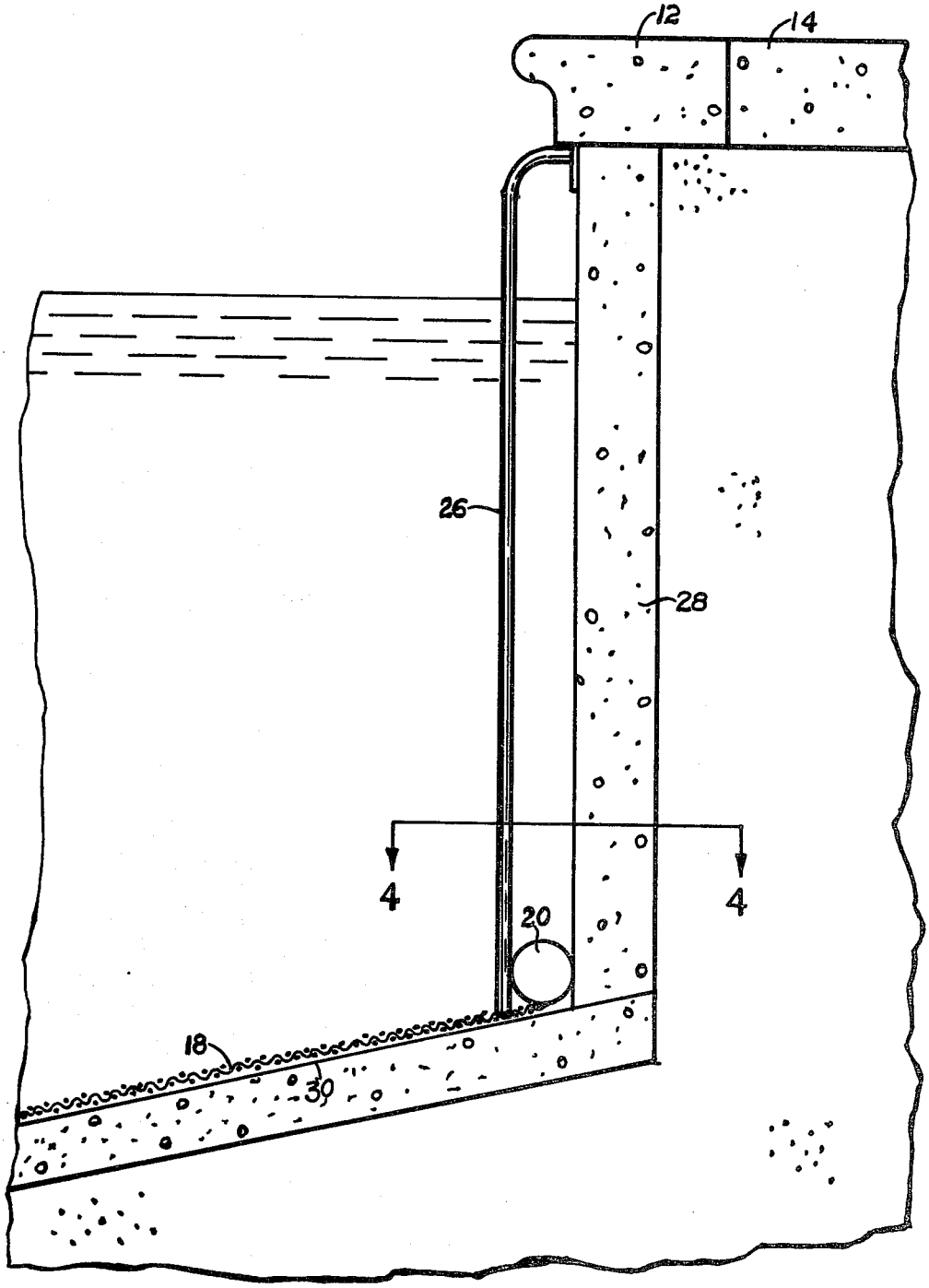
FIG. 2 is a sectional view of the deep end of a pool with my net and bladder in submerged position.

The netting may be secured to the bladder in any suitable manner and is shown in FIG. 2 as encircling peripheral portion 20 of the bladder, and resting on the bottom 30 of the pool. The vertical rods 26—26 are curved at their upper ends and secured to wall 28 immediately below coping 12, thus presenting no obstruction atop the coping or walkway.

Figure 3:
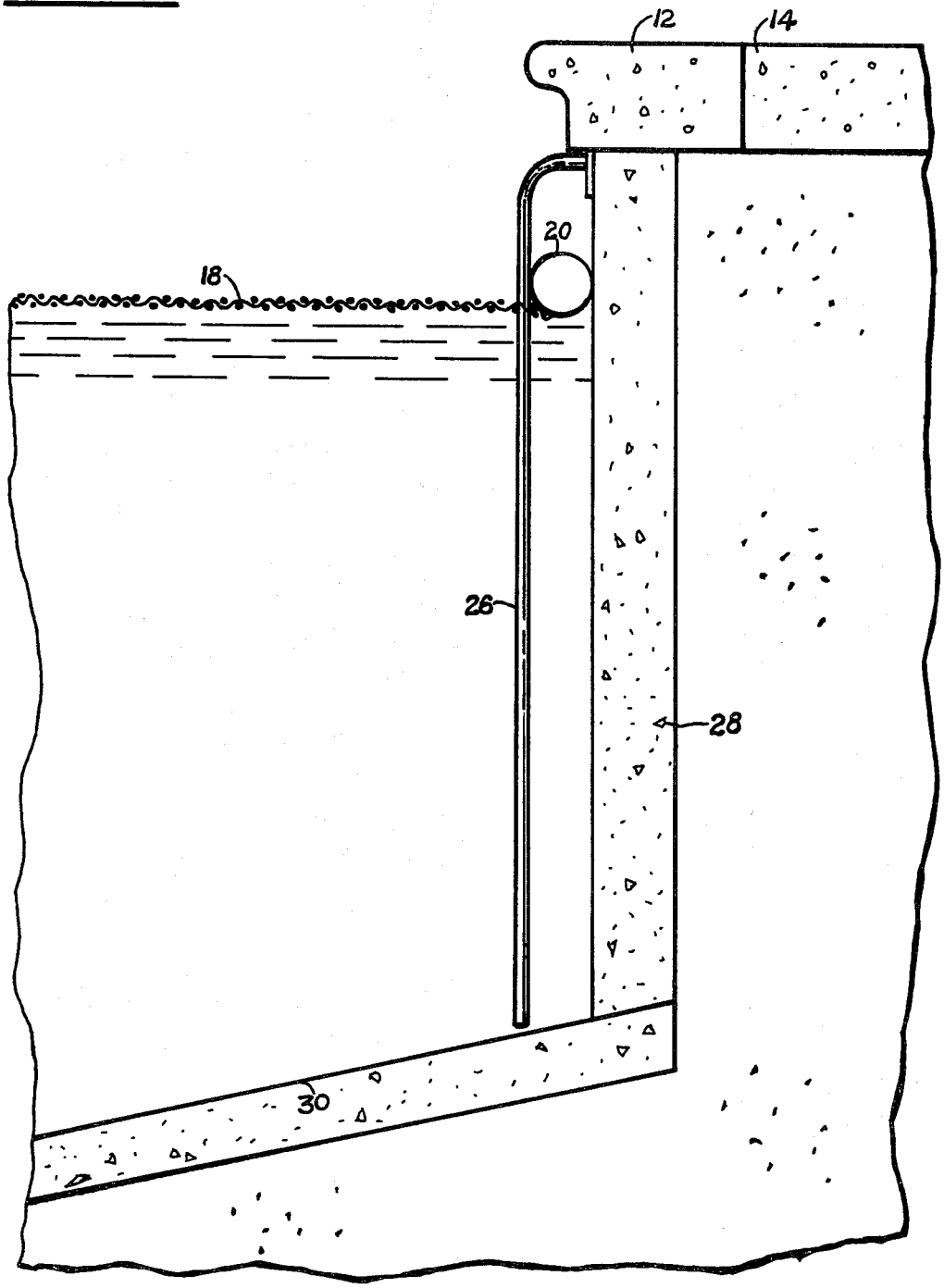
FIG. 3 is a view similar to FIG. 2 with the net and bladder in operable or inflated position.
Figure 4:
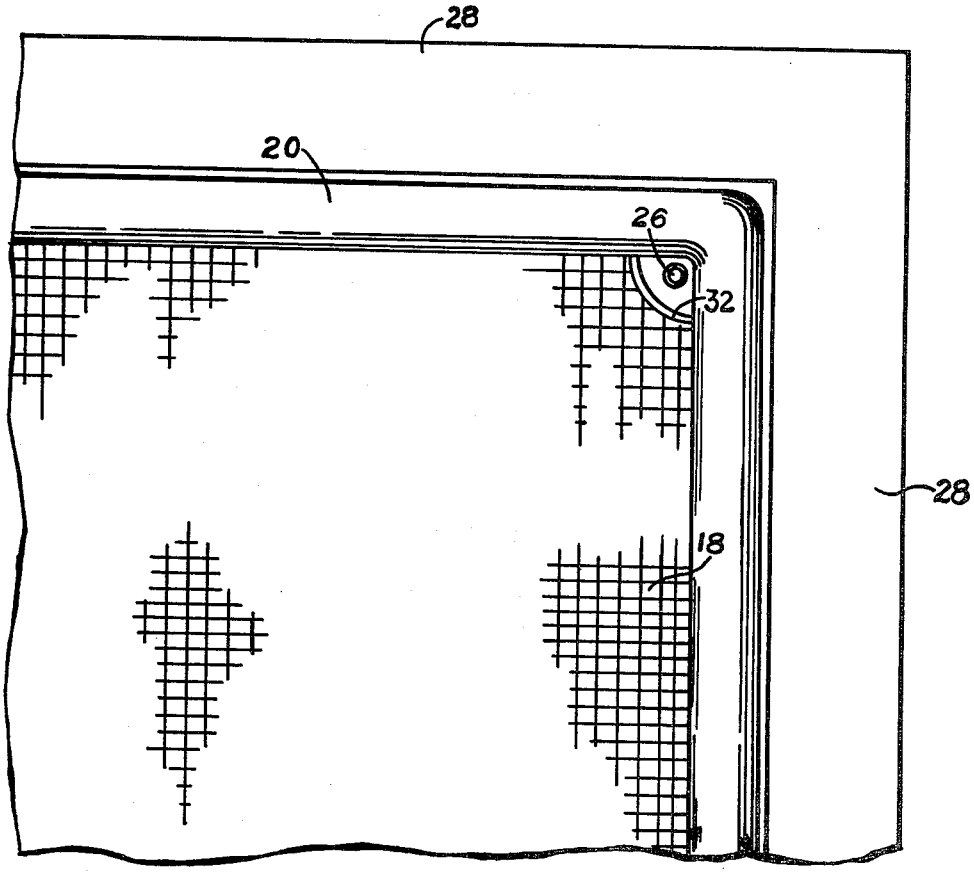
FIG. 4 is a top sectional view taken along line 4—4 of FIG. 2.

In FIG. 3, the bladder and net are shown in their rescue or inflated position, while FIG. 4 illustrates the arcuate configuration 32 of the netting adjacent guide rod 26 to insure unobstructed passage of the netting material upwardly when bladder is inflated.

Figure 5:
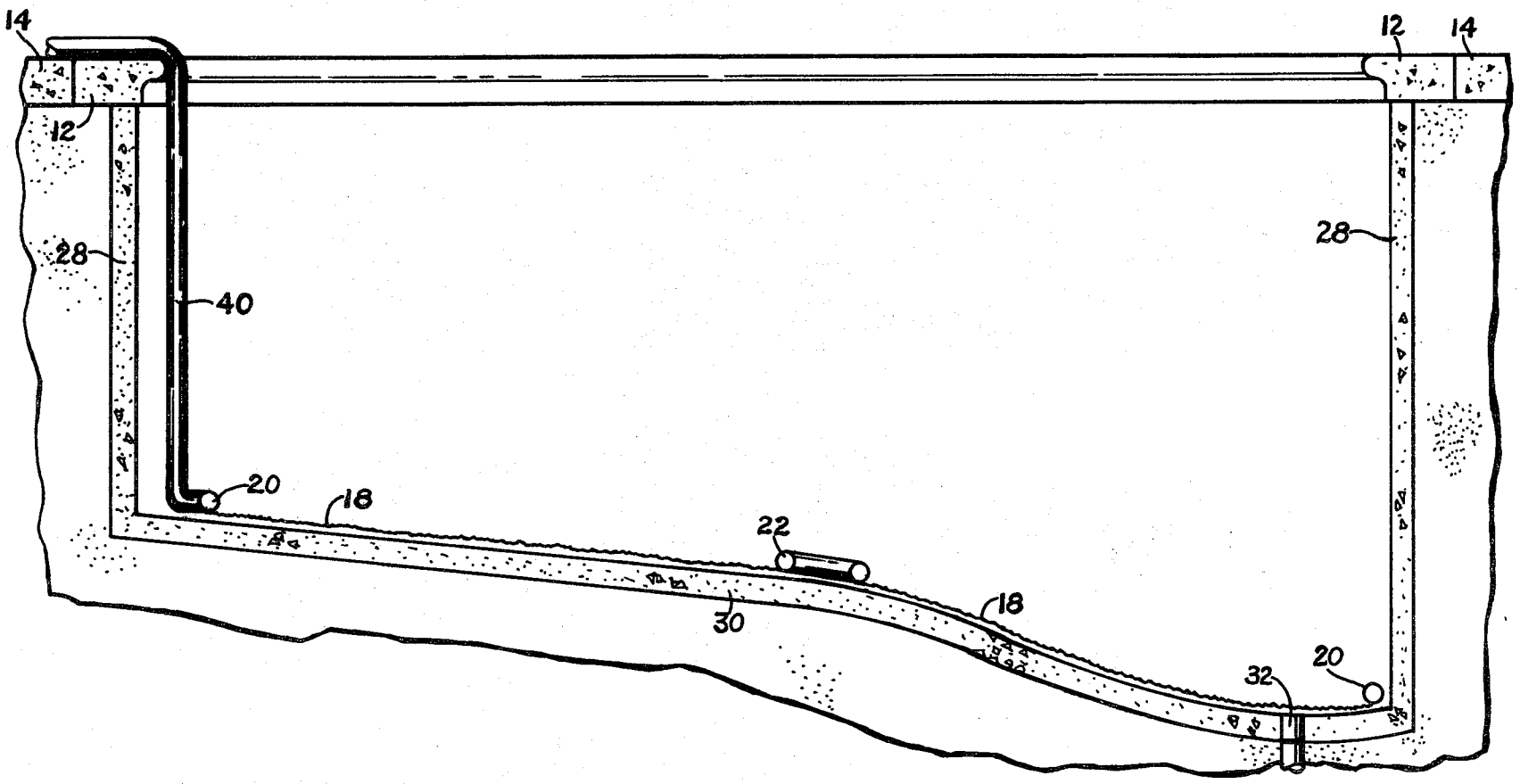
FIG. 5 is a central longitudinal section of a typical swimming pool with my rescue apparatus in its submerged position.

The position of the deflated or submerged bladder and netting will assume the position indicated in FIG. 5 and are shown slightly removed from wall 28 at the shallow end of the pool to permit the bladder in its inflated position to be fully extended around the entire pool area. Further, no guide rods are necessary at the pool's shallow end since the sudden onrush of inflating air will cause the bladder to immediately extend and contact the respective walls of the pool. The operation of the pool drain 32 will not be affected by the presence of the netting resting thereover due to the large space openings thereof.

A hose 40, of approximately the diameter of the bladder's ribs and peripheral portions leads from a peripheral portion at the shallow end to a compressor tank (not shown) of sufficient size for rapidly inflating the bladder. The tank will be pressurized by any suitable electric compressor (also not shown), the pressure within the tank being sufficient to start the bladder moving upwardly instantaneously and to the water's surface in 1–2 seconds.

In the operation of my rescue net, the tank valve (not shown) will be opened by throwing an electric switch located at a console 50 (FIG. 1).

For a small pool having a length of 20 feet and a width of 10 feet, and using ribs and peripheral portions having a diameter of 3 inches, and a hub approximately 24 inches in diameter, as illustrated in FIG. 1.

Immediately upon actuation of the tank valve, the bladder and net will rise to the surface of the water to bring the child or victim therealong. After completion of the rescue, the bladder and net may be submerged manually by simply deflating the bladder or a vacuum pump may be used to remove all air from the bladder. In either case, the weight of the rubber bladder and netting will cause it to once again submerge itself, the guide rods 26—26 guiding the movement of the peripheral portions of the bladder at the deeper end of the pool which has been found adequate to properly control the entire downward movement of the rescue apparatus.

Kidney shaped pools and the like may benefit from the practice of my invention by merely positioning additional guide rods where needed.

My rescue netting may be adapted for ice skating purposes by simply lowering the netting about 6–12 inches below the inflated bladder. Thus, a skater will be prevented from submerging below the ice in the event of an accident. Further, by the simple expendiency of fastening a canvas or other suitable covering over the inflated bladder, the pool can be rendered generally safe while not in use and protected during the off-season.

I claim:

1. Swimming pool rescue apparatus which is completely submerged in its inoperable position and comprising:

an inflatable bladder including an inflatable peripheral portion which mates the configuration of the pool walls and a substantially centrally disposed inflatable hub portion, said peripheral and hub portions having a plurality of inflatable ribs communicating there between, a netting generally coextensive with said peripheral portions and firmly secured to said bladder, a supply means including a supply hose of approximately the same size and material of said ribs and connected to said peripheral portion for rapidly inflating said bladder to cause said bladder and netting to rise to water's surface in said pool in a few seconds, and to mate the configuration of said pool walls, and spaced vertical guide rods having curved top ends which are secured to said pool wall at said curved ends and spaced therefrom at a deep end of said pool to guide the vertical movement of said peripheral portions of said bladder between said guide rods.

2. The rescue apparatus as described in claim 1 wherein said bladder is rubber and peripheral portions and ribs thereof are approximately 3 to 4 inches in diameter.

3. The rescue apparatus as described in claim 1 wherein said netting material is nylon cord having a diameter of about ⅛ inch and openings between successive cords of said netting are approximately 6 inches.

4. The rescue apparatus as described in claim 1 wherein said netting material is arcuately configured at those portions adjacent said vertical guide rods so as to avoid obstruction between said guide rods and said netting.

* * * * *